US012121791B2

(12) United States Patent
Zou et al.

(10) Patent No.: US 12,121,791 B2
(45) Date of Patent: Oct. 22, 2024

(54) FIGHTING SELF-TRAINING DEVICE

(71) Applicant: Beijing Quanshineng Sports Technology Co., Ltd., Beijing (CN)

(72) Inventors: Jiarui Zou, Beijing (CN); Guojun Zou, Beijing (CN)

(73) Assignee: Beijing Quanshineng Sports Technology Co., Ltd.

( * ) Notice: Subject to any disclaimer, the term of this patent is extended or adjusted under 35 U.S.C. 154(b) by 123 days.

(21) Appl. No.: 18/095,026

(22) Filed: Jan. 10, 2023

(65) Prior Publication Data

US 2023/0264090 A1 Aug. 24, 2023

(30) Foreign Application Priority Data

Feb. 23, 2022 (CN) ..... 202220369762.9

(51) Int. Cl.
*A63B 69/34* (2006.01)

(52) U.S. Cl.
CPC ..... *A63B 69/34* (2013.01); *A63B 2225/50* (2013.01)

(58) Field of Classification Search
CPC . A63B 69/34; A63B 2225/50; A63B 69/0053; A63B 2220/805; A63B 69/22; A63B 2244/10
See application file for complete search history.

(56) References Cited

U.S. PATENT DOCUMENTS 8,777,818 B1 * 7/2014 Tate, Jr. ..... A63B 69/215 482/83
9,744,420 B1 * 8/2017 Bergamini ..... A63B 69/22
2004/0224826 A1 * 11/2004 O'Shea ..... A63B 69/222 482/83
2017/0095719 A1 * 4/2017 Hall ..... A63B 69/24

* cited by examiner

*Primary Examiner* — Andrew S Lo
(74) *Attorney, Agent, or Firm* — Jeenam Park

(57) ABSTRACT

The present application provides a fighting self-training device. The adopted technical solution is that a turntable is arranged on the housing, and a swing rod is arranged on the turntable. By controlling the motor to drive the swing rod to rotate, the tilted downward swing rod can be rotated upward from the bottom. When the swing rod is rotated to the highest position, the swing rod is flush with the bottom surface. The rotation of the swing rod simulates the kicking or punching of the training personnel, so as to realize the dodge training of the fighters. A left and right belts are arranged on the housing, and a limiting mechanism is arranged between the left and right belts, and the left and right belts can be connected through the limiting mechanism, so that the height of the device from the ground can be adjusted.

8 Claims, 4 Drawing Sheets

FIGHTING SELF-TRAINING DEVICE

CROSS-REFERENCE TO RELATED APPLICATIONS

This is a U.S. patent application which claims the priority and benefit of Chinese Patent Application Number 202220369762.9, filed on Feb. 23, 2022, the disclosure of which is incorporated herein by reference in its entirety.

TECHNICAL FIELD

The present application relates to the technical field of training equipment, specifically a fighting self-training device.

BACKGROUND

Free fighting, stand-up fighting, refers to that one party falls to the ground and just does not allow the other party to hit, and cannot use anti joints, elbows, etc. at the same time, and the wrestling method is also prohibited to a certain extent.

Free fighting does not stick to any fixed routine moves, but advocates free play in actual fighting according to the battle situation, with an open style, flexible use f various three-dimensional techniques such as punches, feet, elbows, knees and wrestling. The aim is to finally knock down or defeat the opponent. "Tell me the basic principles, and I will come up with unique techniques that suit me." This is the best general expression of the kickboxing philosophy. Under the guidance of this idea, after decades of practice and learning from each other, free fighting has formed a perfect theory, technical and tactical system and competition rules. In fact, "free fighting" can use techniques such as boxing and kicking.

Free fighting, also known as international free fighting, European and American full-contact free karate, etc. It originated in Europe and America in the 1960s, with the United States as the main origin and development center. Under the influence of the Western cultural environment, free fighting has gradually been bred and developed in the historical background of large-scale exchanges, collisions and open integration of global culture and economy. It is a Western freestyle full-contact unarmed offensive and defensive fighting technique that has no routines, no sects, emphasizes individual style, and focuses on winning in actual combat.

Due to the commercialization of free fighting competitions, the degree of professionalization is high, and the openness is good. In almost all international free fighting competitions, the method of "unrestricted free competition" is adopted, and the qualifications of contestants are not limited to carry out fall-contact fighting competitions. Therefore, free fighting competitions are often extremely tense and intense, which is very attractive to boxing fans and audiences, and puts forward higher and more comprehensive requirements for free kickboxers' overall fighting abilities such as technical and tactical levels, fighting will, physical fitness, and resistance. Moreover, free fighting breaks sectarian boundaries, and any group or individual that recognizes its competition rules can participate in free fighting competitions, which objectively provides conditions tar the exchange of various schools of martial arts in the world and the testing and improvement of free fighting technical systems. Therefore, the free fighting competition system is regarded by the international martial arts world as the ultimate mode of martial arts fighting, and it is regarded as the only fair way to truly experience the pros and cons of martial arts and the true strength of players. In this way, the rules of free fighting competitions have become the popular and recognized standards of international martial arts competitions.

In fighting training, fighters can use training equipment to train their own offense. When training dodge, most fighters need the cooperation of others, others attack themselves, and dodge themselves, so as to realize the training of dodge. However, asking others to help you train, the training cost is relatively high; the existing fighting training device can only repeat a certain action mechanically, and has little effect on the dodging training of fighters. Therefore, need a kind of fighting self-training device to solve the above problems.

SUMMARY

In view of the problems existing in the prior art, the present application discloses a fighting self-training device. The adopted technical solution is, comprising a housing, a left belt and a right belt, wherein the left belt and the right belt are respectively provided on both sides of the housing, a limiting mechanism is arranged between the left belt and the right belt; the longitudinal section of the housing is a right-angled trapezoid, and a turntable is rotatable connected to a slope of the housing, the turntable comprises an inner side and an outer side, and the outer side is located outside of the housing, and a swing rod is provided on the outer side, and a soft body is provided on the swing rod; the inner side is located inside the housing, and the inner side is provided with teeth, and a gear meshing with the teeth is arranged inside the housing, and the gear is driven by a motor, a controller is also arranged in the housing, and the controller is equipped with a wireless transmission module, a motor frequency converter and a microprocessor, and the housing is also provided with a power connector, and the controller is connected to the power connector and the motor.

As a preferred technical solution of the present application, a photoelectric switch is provided between the inside of the housing and the turntable, and the photoelectric switch is connected with the controller. The turntable is arranged on the housing, and a swing rod is arranged on the turntable. By controlling the motor to drive the swing rod to rotate, the tilted downward swing rod can be rotated upward from the bottom. When the swing rod is rotated to the highest position, the swing rod is flush with the bottom surface. The rotation of the swing rod simulates the kicking or punching of the training personnel, so as to realize the dodge training of the fighters.

As a preferred technical solution of the present application, the soft body is made of rubber or silicone. The soft body is made of silica gel or rubber material, which can prevent the trainer from being injured when the swing rod hits the trainer with great force.

As a preferred technical solution of the present application, the limiting mechanism comprises a clamping shell and a clamping rod, and the clamping shell is a shell, and is arranged at the end of the left belt, the clamping rod is rotatably connected to the clamping shell, and a torsion spring is pressed between the clamping rod and the clamping shell, and the clamping shell is also provided with a through hole for the right belt to pass through, and the right belt is provided with a clamping slot, and the clamping slot matches the size and position of the clamping rod, and the clamping shell is also provided with a press hole corresponding to the position of the clamping rod. A left belt and a right belt are arranged on the housing, and a limiting mechanism is arranged between the left belt and the right belt, and the left belt and the right belt can be connected through the limiting mechanism, so that the housing, the left belt and the right belt form a ring shape. The housing could be fixed on a column or other equipment, and the height of the training device from the ground can be adjusted. Through the rotation of the swing rod, the kick or punch can be simulated, so that fighters can train themselves through the training device.

As a preferred technical solution of the present application, the clamping rod is rotatably connected to the inside of the clamping shell through a rotating shaft, and the torsion spring is sleeved on the rotating shaft.

As a preferred technical solution of the present application, the motor is configured to be an anti-lock motor.

As a preferred technical solution of the present application, the turntable is rotatably connected to the housing through a bearing seat, the motor is configured to be an anti-lock motor, thereby avoiding the problem of motor damage caused by the swing rod being blocked by the trainer.

As a preferred technical solution of the present application, the left belt and the right belt are made of leather.

Beneficial effects of the present application: the present application is by, arranging turntable on housing, and swing rod is arranged on turntable, drives swing rod to rotate by controlling motor, the tilted downward swing rod can be rotated upward from the bottom. When the swing rod is rotated to the highest position, the swing rod is flush with the bottom surface, and the rotation of the swing rod simulates the kicking or punching of the training personnel, so as to realize the dodge training for fighters. A left belt and a right belt are arranged on the housing, and a limiting mechanism is arranged between the left belt and the right belt, and the left belt and the right belt can be connected through the limiting mechanism, so that the housing, the left belt and the right belt form a ring shape. The housing could be fixed on a column or other equipment, and the height of the training device from the ground can be adjusted. Through the rotation of the swing rod, the kick or punch can be simulated, so that fighters can train themselves from passive to active through the training device.

Further, soft body is made of silica gel or rubber material, which can prevent the trainer from being injured when the swing rod hits the trainer with great force. A photoelectric switch is installed inside the housing and used in conjunction with the motor, which can automatically reset the swing rod before use; the motor adopts an anti-lock motor, which can avoid the problem of motor damage caused by the swing rod being blocked by the trainer.

BRIEF DESCRIPTION OF DRAWINGS

In order to more clearly illustrate the specific embodiments of the present application or the technical solutions in the prior art, the following will briefly introduce the drawings that need to be used in the description of the specific embodiments or the prior art. Throughout the drawings, similar elements or parts are generally identified by similar reference numerals. In the drawings, elements or parts are not necessarily drawn in actual scale.

REFERENCE SIGNS

1. Housing; 2. Left belt; 3. Right belt; 4. Turntable; 5. Swing rod; 6. Soft body; 7. Gear; 8. Motor; 9. Photoelectric switch; 10. Controller; 11. Clamping shell; 12. Clamping rod; 13. Torsion spring; 14. Pressing hole.

DETAILED DESCRIPTION

In the description of the present application, it should be noted that the orientation or positional relationship indicated by terms "center", "upper", "lower", "left", "right", "vertical", "horizontal", "inner" and the like is based on the orientation or positional relationship shown in the accompanying drawings, only for the convenience of describing the application, rather than indicating or implying that the device or element referred to must have a specific orientation, be constructed in a specific orientation, and operate, and thus should not be construed as limiting the application. In addition, the terms "first", "second", and "third" are used for descriptive purposes only, and should not be construed as indicating or implying relative importance.

In the description of the present application, it should be noted that, unless otherwise specified and limited, the terms "installation", "connection" and "connected" should be understood in a broad sense. For example, it can be a fixed connection, a detachable connection, or an integral connection; it can be a mechanical connection or an electrical connection, it may be directly connected, or indirectly connected through an intermediary, and may be internally connected between two elements. A person skilled in the art can understand the specific meanings of the above terms in this application in specific situations.

Approximate terms in the specification and claims are used to describe the quantity, which means that the application is not limited to the specific quantity, but also includes acceptable modifications close to the quantity that do not cause changes in the relevant basic functions. Accordingly, a numerical value modified by "about" etc., means that the present application is not limited to the precise numerical value. In some instances, approximate terms may correspond to the precision of the instrument for measuring the value. Throughout the specification and claims of this application, range limitations may be combined and/or interchanged, unless otherwise stated such ranges include all subranges contained therebetween.

As used herein, the term "prepared from" is synonymous with "comprising". As used herein, the terms "comprises," "including," "has," "containing," or any other variation thereof, are intended to cover a non-exclusive inclusion. For example, a composition, step, method, article, or device comprising listed elements is not necessarily limited to those elements, but may include other elements not explicitly listed or inherent to such composition, step, method, article, or device.

Embodiment 1

Figure 1:
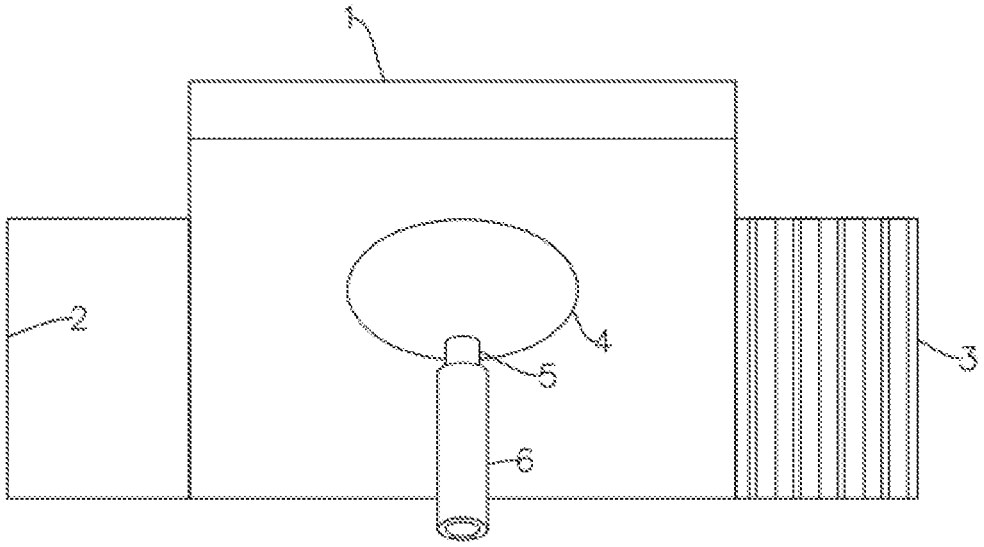
FIG. 1 is a schematic structural diagram of the present application.
Figure 2:
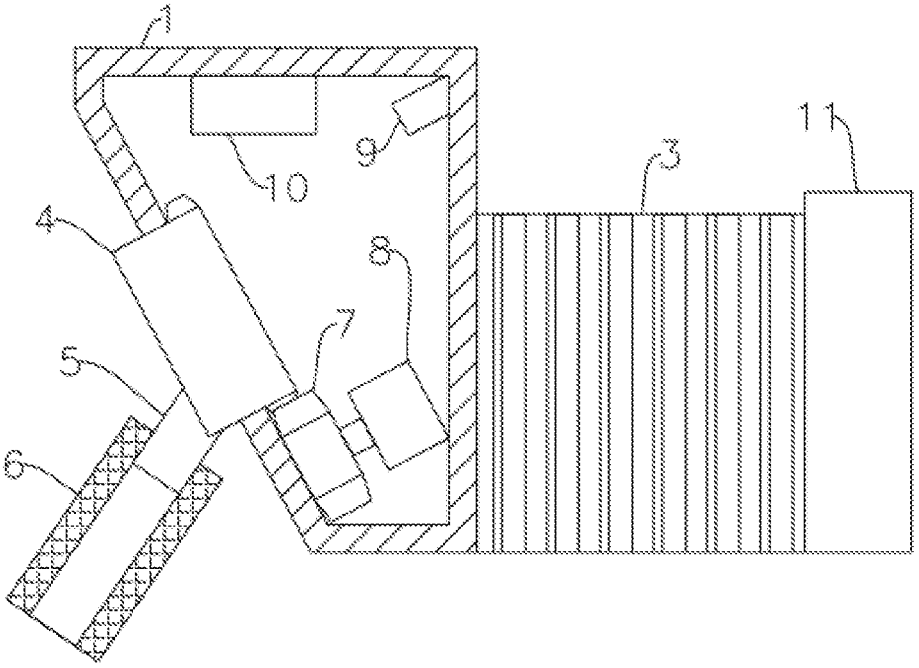
FIG. 2 is a side view structural schematic diagram I of the present application.
Figure 3:
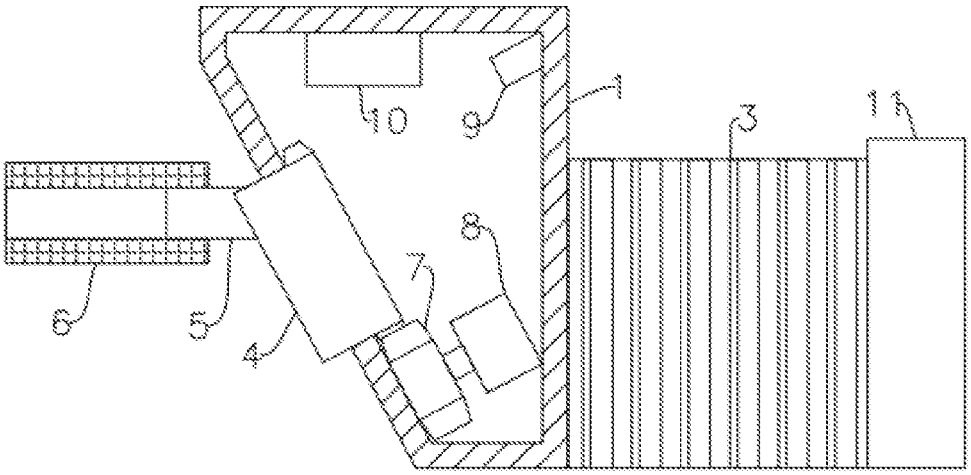
FIG. 3 is a side view structural schematic diagram II of the present application.
Figure 4:
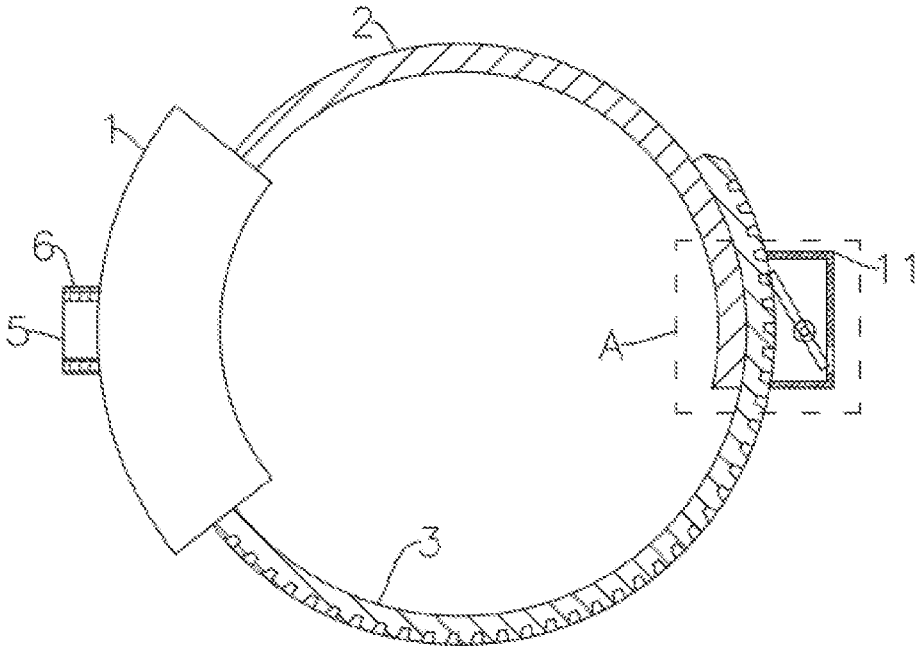
FIG. 4 is a structural schematic diagram of top view of the present application.
Figure 5:
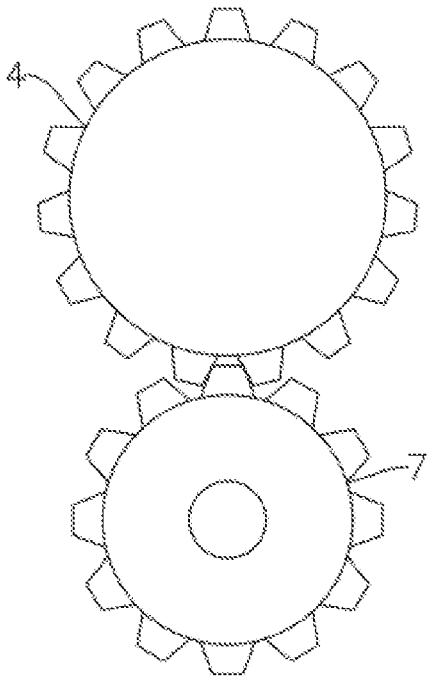
FIG. 5 is a partial structural diagram of the present application.
Figure 6:
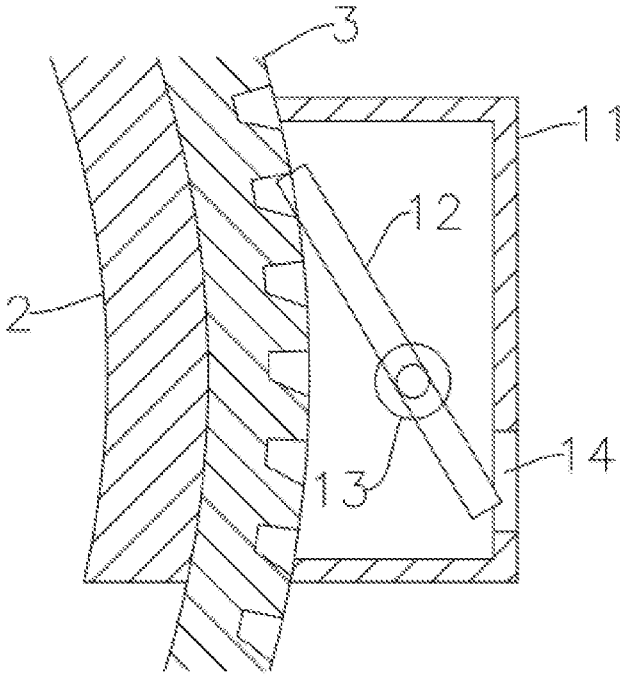
FIG. 6 is an enlarged view at A of the present application.

As shown in FIG. 1 to FIG. 6, the present application discloses a fighting self-training device, the technical solution that adopts is, comprises housing 1, left belt 2 and right belt 3, wherein the left belt 2 and the right belt 3 are respectively provided on both sides of the housing 1, a limiting mechanism is arranged between the left belt 2 and the right belt 3; One end of the left belt 2 and the right belt 3 is connected with the housing 1 and the other end of the left belt 2 and the right belt 3 is connected through the limiting mechanism; the longitudinal section of the housing 1 is a right-angled trapezoid, and a turntable 4 is rotatably connected to a slope of the housing 1, the turntable 4 comprises an inner side and an outer side, and the outer side is located outside of the housing 1, and a swing rod 5 is provided on the outer side, the swing rod 5 is welded on the turntable 4, and a soft body 6 is provided on the swing rod 5; the inner side is located inner cavity of the housing 1, and the inner side is provided with teeth, and a gear 7 meshing with the teeth is arranged inside the housing 1, and the gear 7 is driven by a motor 8 and the gear 7 is arranged on the output shaft of the motor 8. A controller 10 is also arranged in the housing 1, and the controller 10 is equipped with a wireless transmission module, a motor frequency converter and a microprocessor, wherein the wireless transmission module adopts a 2.4 GHz wireless communication module. The housing 1 is also provided with a power connector, and the controller 10 is connected to the power connector and the motor 8, the power connector can be connected to electricity, so that the controller 10 and the motor 8 are connected to electricity.

As a preferred technical solution of the present application, a photoelectric switch 9 is provided between the inside of the housing 1 and the turntable 4, and the photoelectric switch 9 is connected with the controller 10. When the turntable 4 is in the initial state, the swing rod 5 is under the turntable 4 and tilts downward, at this time the photoelectric switch 9 is turned on; When the power connector is unplugged and the photoelectric switch 9 is in the disconnected state, the microprocessor controls the rotation of the motor 8 when the power connector is connected to the power next time, and drives the turntable 4 to rotate through the gear 7, so that the photoelectric switch 9 is turned on, and the turntable 4 is reset at the same time.

As a preferred technical solution of the present application, the soft body 6 is made of rubber or silica gel or is designed to imitate the arms and legs of the human body. When the swing rod 5 rotates, the soft body 6 is driven to simulate punching or kicking. The soft body 6 is designed in such a way that it is possible to avoid injury to the trainer if it hits the trainer.

As a preferred technical solution of the present application, the limiting mechanism comprises a clamping shell 11 and a clamping rod 12, and the clamping shell 11 is a shell, and is arranged at the end of the left belt 2, the clamping rod 12 is rotatably connected to the clamping shell 11, and a torsion spring 13 is pressed between the clamping rod 12 and the clamping shell 11, and the clamping shell 11 is also provided with a through hole for the right belt 3 to pass through, and the right belt 3 is provided with a clamping slot, and the clamping slot matches the size and position of the clamping rod 12, and the clamping shell 11 is also provided with a press hole 14 corresponding to the position of the clamping rod 12.

As a preferred technical solution of the present application, the clamping rod. 12 is rotatably connected to the inside of the clamping shell 11 through a rotating shaft, and the torsion spring 13 is sleeved on the rotating shaft.

As a preferred technical solution of the present application, the motor 8 is configured to be an anti-lock motor, it can avoid that after the swing rod 5 is blocked, the motor 8 continues to work, resulting in damage to the motor 8 due to internal heating.

As a preferred technical solution of the present application, the turntable 4 is rotatably connected to the housing 1 through a bearing seat. The bearing seat can reduce the frictional force between the turntable 4 and the housing 1 and reduce the energy consumption of the turntable 4.

As a preferred technical solution of the present application, the left belt 2 and the right belt 3 are made of leather. The width of the left belt 2 and the right belt 3 can be increased, so that the housing 1 can be fixed more stably.

Working principle of the present application: when in use, the left belt 2 and the right belt 3 are wrapped around the column or other utensils for installation, so that the ring formed by the left belt 2, the right belt 3 and the housing 1 is sleeved on other utensils or columns. Pass the end of the right belt 3 through the through hole on the clamping shell 11, and the right belt 3 pushes the clamping rod 12 to rotate around the rotating shaft, and the torsion spring 13 accumulates force at the same time. When the bottom end of the clamping rod 12 corresponds to the position of the clamping groove on the right belt 3, the bottom end of the clamping rod 12 is embedded in the clamping groove under the elastic force of the torsion spring 13, and carry out real-time limit on the right belt 3, and fix the housing 1 on other utensils or columns.

After fixing is finished, the power connector on the housing 1 is connected to electricity. Trainers can control the rotation of the motor 8 through the microprocessor in the controller 10, thereby driving the turntable 4 to rotate on the housing 1. Turn the turntable 4 to rotate 360°, rotate the swing rod 5 from the downwardly inclined state to be horizontal with the bottom surface, thereby striking the trainer and training his ability to dodge. The swing rod 5 continues to rotate along with turntable 4, and when turntable 4 rotated to initial position, the photoelectric switch 9 on the housing 1 corresponds to turntable 4 positions, and now motor 8 stops working, and a dodge training is completed.

Be fixed on other utensils or column by left belt 2 and right belt 3, when the height from the ground of housing 1 is half a person's height, trainer can simulate kicking action, and the height from ground of housing 1 is as high as the trainer's shoulder, the trainer can simulate punching action; The trainer can control the rotating speed of the motor 8 through the motor frequency converter in the controller 10, so as to realize the speed of controlling the rotation of the swing rod 5, so as to control the speed at which the trainer simulates punching or kicking.

In addition, microprocessor adopts STM32 chip, is used for starting and stopping motor, and in terms of STM32 pins and connection methods, those skilled in the art can refer to textbooks or technical manuals published by manufacturers to obtain technical inspiration.

The circuit connection that the present application relates to is the customary means that those skilled in the art adopt, can obtain technical enlightenment through limited number of tests, belongs to common knowledge.

Components not specified herein are prior art.

Although the specific embodiments of the present application have been described in detail above, the present application is not limited to the above embodiments. Within the scope of knowledge of those skilled in the art, various changes can be made without departing from the gist of the present application, and modifications or deformations that do not involve creative work are still within the protection scope of the present application.

What is claimed is:

1. A fighting self-training device, comprising a housing, a first belt and a second belt, wherein the first belt and the second belt are respectively provided on one side and another side of the housing, a limiting mechanism is arranged between the first belt and the second belt; a longitudinal section of the housing is a right-angled trapezoid, and a turntable is rotatably connected to a slope of the housing, the turntable comprises an inner side and an outer side, and the outer side is located outside of the housing, and a swing rod is provided on the outer side, and a soft body is provided on the swing rod; the inner side is located inside the housing, and the inner side is provided with teeth, and a gear meshing with the teeth is arranged inside the housing, and the gear is driven by a motor, a controller is also arranged in the housing, and the controller is equipped with a wireless transmission module, a motor frequency converter and a microprocessor, and the housing is also provided with a power connector, and the controller is connected to the power connector and the motor;

wherein the limiting mechanism comprises a clamping shell and a clamping rod.

2. The fighting self-training device according to claim 1, wherein a photoelectric switch is provided between the inside of the housing and the turntable, and the photoelectric switch is connected with the controller.

3. The fighting self-training device according to claim 1, wherein the soft body is made of rubber or silicone.

4. The fighting self-training device according to claim 1, wherein the clamping shell is a shell, and is arranged at an end of the first belt, the clamping rod is rotatably connected to the clamping shell, and a torsion spring is pressed between the clamping rod and the clamping shell, and the clamping shell is also provided with a through hole for the second belt to pass through, and the second belt is provided with a clamping slot, and the clamping slot matches the size and position of the clamping rod, and the clamping shell is also provided with a press hole corresponding to the position of the clamping rod.

5. The fighting self-training device according to claim 4, wherein the clamping rod is rotatably connected to the inside of the clamping shell through a rotating shaft, and the torsion spring is sleeved on the rotating shaft.

6. The fighting self-training device according to claim 1, wherein the motor is configured to be an anti-lock motor.

7. The fighting self-training device according to claim 1, wherein the turntable is rotatably connected to the housing through a bearing seat.

8. The fighting self-training device according to claim 1, wherein the first belt and the second belt are made of leather.

* * * * *